United States Patent [19]

Migita et al.

[11] Patent Number: 4,862,033

[45] Date of Patent: Aug. 29, 1989

[54] ELECTROLUMINESCENT DISPLAY APPARATUS HAVING A MULTI-COLOR ILLUMINANT LAYER AND PROCESS FOR PRODUCING THE SAME

[75] Inventors: Masahito Migita, Hachioji; Osam Kanehisa, Kodaira; Masatoshi Shiiki, Kokubunji; Hajime Yamamoto, Tokyo, all of Japan

[73] Assignee: Hitachi, Ltd., Tokyo, Japan

[21] Appl. No.: 85,762

[22] Filed: Aug. 17, 1987

[30] Foreign Application Priority Data

Sep. 16, 1986 [JP] Japan ..... 61-216036

[51] Int. Cl.[4] ..... H05B 33/14

[52] U.S. Cl. ..... 313/502; 313/509; 428/690

[58] Field of Search ..... 313/502, 504, 506, 509; 428/477.7, 690, 917

[56] References Cited

U.S. PATENT DOCUMENTS 4,143,297 3/1979 Fischer ..... 313/503

OTHER PUBLICATIONS

Proceedings of the S.I.D., vol. 25, No. 1, 1/1984, pp. 3-5, S.I.D., Los Angeles, CA, Kitai et al., "Two-Color Thin-Film Electroluminescence with Spatially Selective Activator Doping".

*Primary Examiner*—Kenneth Wieder

*Attorney, Agent, or Firm*—Antonelli, Terry & Wands

[57] ABSTRACT

A multi-color single layer electroluminescent display apparatus comprising a illuminant layer having been interposed between a pair of electrode layers and having a plurality of activators doped at spatially different locations is disclosed. A process for producing an electroluminescent display apparatus comprising doping with a plurality of activators at spatially different locations on forming a illuminant layer is also disclosed.

30 Claims, 3 Drawing Sheets

ELECTROLUMINESCENT DISPLAY APPARATUS HAVING A MULTI-COLOR ILLUMINANT LAYER AND PROCESS FOR PRODUCING THE SAME

BACKGROUND OF THE INVENTION

1. FIELD OF THE INVENTION

This invention relates to a multi-color film electroluminescent display apparatus of a matrix type in which apparatus a plurality of EL luminous layers are provided on a plane, and a production process thereof.

2. DESCRIPTION OF THE RELATED ART

A display apparatus constructed of a plurality of electroluminescent (hereinafter referred to as EL) elements having different luminous colors is described as an example of first conventional technique in Proceedings of the 3rd International Display Research Conference, p 570 (1983), Kobe. The structure of the conventional apparatus is illustrated in FIG. 4. This apparatus comprises first illuminant layer 33 comprising $ZnS:SmF_3$ (0.5% by weight) interposed between dielectric films 32 and 34 such as $Y_2O_3$ or the like; said illuminant is provided on a glass base 30 through first transparent electrode 31, and second illuminant layer 37 comprising $ZnS:TbF_3$ (2% by weight) interposed between dielectric films 36 and 38 such as $Y_2O_3$ or the like; said illuminant is provided on the first illuminant layer 33 through second transparent electrode 35 such as ITO or the like. It is possible to obtain red luminescence having a wave length of about 650 nm from the first illuminant layer 33 by impressing an alternating voltage between the first electrode 31 and the second electrode 35 and green luminescence having a wave length of about 540 nm from the second illuminant layer 37 by impressing an alternating voltage between the second electrode 35 and an uppermost electrode 39.

On the other hand, display apparatuses comprising a plurality of EL elements on a plane and production processes thereof are described, for example, in Japanese Patent Application Kokai (Laid-Open) No. 257097/85. In this conventional technique, a transparent electrode having a thickness of about 0.1 82 m is formed on a transparent substrate, and a first dielectric film comprising $Y_2O_3$ and having a thickness of about 0.4 μm is formed by electron beam deposition or sputtering methods. Next, a resist film having a thickness of 2 μm is formed on the dielectric film, and a light absorber having a thickness of 0.4 μm is then formed in a shape of a lattice by a resistance heating method or the like. A protective layer comprising, for example, $SiO_2$ is formed on the aforementioned light absorber. After ultrasonic cleaning of the aforementioned substrate by dipping into an organic solvent such as acetone, the resist film and the light absorber and the protective film thereof on the resist film are removed completely, and a resist film having a thickness of about 2 μm is formed again into a predetermined shape. Then, the first illuminant layer, for example, a ZnS film containing 2% by weight of $TbF_3$ and having a thickness of about 0.4 μm is formed by an electron beam deposition method, an ion beam sputtering method or a magnetron sputtering method. Then, the substrate is subjected to ultrasonic cleaning in an organic solvent such as acetone to remove the resist film. In order to remove completely the resist film, an etching mask is formed with the use of, for example, a resist film so that an aperture with a predetermined shape is provided only on the first illuminant on the resist film. Then, the first illuminant on the resist film is removed by an ion beam etching method with the use of argon gas or the like to expose the resist film, and then ultrasonic cleaning is carried out in an acetone organic solvent. Next, a resist film is formed again in the same manner, and the second illuminant, for example, a ZnS film containing 0.5% by weight of $SmF_3$ is formed by an ion beam sputtering method.

When a display apparatus comprises three luminant colors, it is necessary to add further an additional process which is similar to those described above. After the second or third illuminant layer is formed, a resist film is completely removed by the same process as above.

Then, after the back surface of the substrate is protected with a resist or a tape, the substrate is dipped into a mixed solution of hydrofluoric acid and ammonium fluoride ($NH_4F$) to remove completely a protective layer and an illuminant on the protective layer.

In the above-mentioned first conventional technique, the second illuminant layer 37 is formed on the uppermost layer wherein several layers of film are superposed, so that it is significantly affected by the factors such as unevenness of the base substance, stain or the like during the course of the production of a film, and the film thus formed is deteriorated extensively as compared with a film of the illuminant layer 33 simply formed on the dielectric layer. Thus, it is known that brightness from the aforementioned illuminant layer comprising two layers is decreased in a range of 60–70% as compared with that from a single layer. Further, as for the electrode for operating the first illuminant layer 33, both of the upper and lower electrodes are ITO films 31 and 35. It is also well-known that such an electrode construction as above tends to spread its dielectric breakdown range of elements as compared with an electrode construction comprising an ITO film and an Al film. It is also considered that in such a construction as in the conventional example, defects of a film, localized deposition of impurities or stains per unit area or the like are necessarily in a higher level rather than in an element comprising single layer illuminant and thus the former construction tends to be broken down. On its breakdown, the first and second illuminants 33 and 37 become inoperable by the damage of the second electrode 35. Thus, when a matrix type EL display apparatus is constructed with the EL elements having the aforementioned construction, a problem is encountered in that the number of the defects of the picture elements increases as compared with the case of the illuminant comprising a single layer.

Next, in the aforementioned second conventional technique, a resist film is directly formed on an $Y_2O_3$ dielectric film or an illuminant film, so that the interfaces of dielectric films or illuminant films which effect seriously the properties of the EL element are contaminated by impurities. Furthermore, ultrasonic cleaning in an organic solvent such as acetone and then dipping into an oxygen plasma atmosphere for removing the aforementioned resist film enhances the contamination and possibly deteriorates the properties of the dielectric film itself and the crystal properties of the illuminant film. All of these deteriorative effects will apparently cause the deterioration of the EL element and thus cannot be accepted as such. Further, in the second conventional technique, a complicated process comprising at least 15 steps is required even for producing an EL display apparatus comprising two color illuminant films. The process exceeds 20 steps by the addition of essential steps such as drying, thermal treatment and the like, and thus a serious problem which cannot be accepted from the industrial viewpoint of cost or yield, was encountered in the second conventional technique.

SUMMARY OF THE INVENTION

The object of this invention is to provide an improved electroluminescent display apparatus and a production process thereof.

Another object of this invention is to provide an electroluminescent apparatus having a simple structure and a production process thereof.

Further object of this invention is to provide an electroluminescent display apparatus having a high brightness and a production process thereof.

Even further object of this invention is to provide an electroluminescent display apparatus which may be manufactured with ease and a production process thereof.

Another object of this invention is to provide an electroluminescent display apparatus which is hardly broken down and a production process thereof.

Another object of this invention is to provide an electroluminescent display apparatus, which is few in electrode layers and in insulating layers which are formed in contact with the electrode layers, and radiates multicolors, and a production process thereof.

Further object of this invention is to provide an electroluminescent display apparatus in which film properties in an illuminant layer will be hardly degraded and a production process thereof.

Another object of this invention is to provide an electroluminescent display apparatus which will hardly cause dielectric breakdown phenomenon, or will scarcely be deterioratively affected by the phenomenon, and a production process thereof.

Another object of this invention is to provide an electroluminescent display apparatus which will hardly be contaminated during the course of its production, and a production process thereof.

Another object of this invention is to provide an electroluminescent display apparatus in which defects in the picture element will hardly be caused and a production process thereof.

For the purpose of accomplishing the abovementioned objects and other objects, this invention employs an electroluminescent display apparatus comprising a structure in which an illuminant layer is interposed between a pair of electrodes and has a plurality of activators being doped in different spacial locations.

For the purpose of accomplishing the abovementioned objects and other objects, this invention employs a process for producing an electroluminescent display apparatus, in which process a plurality of activators are doped in different spatial locations on forming the illuminant layer.

With the above and other objects in view, the invention consists in the construction and the method hereinafter fully described, illustrated in the accompanying drawings, and set forth in the claims hereto appended, it being understood that various changes in the form, proportion, minor details of construction and the operation, within the scope of the claims, may be restored to without departing from the spirit of the invention, or sacrificing any of the advantages thereof

DETAILED DESCRIPTION OF THE PREFERRED EMBODIMENTS

Figure 1:
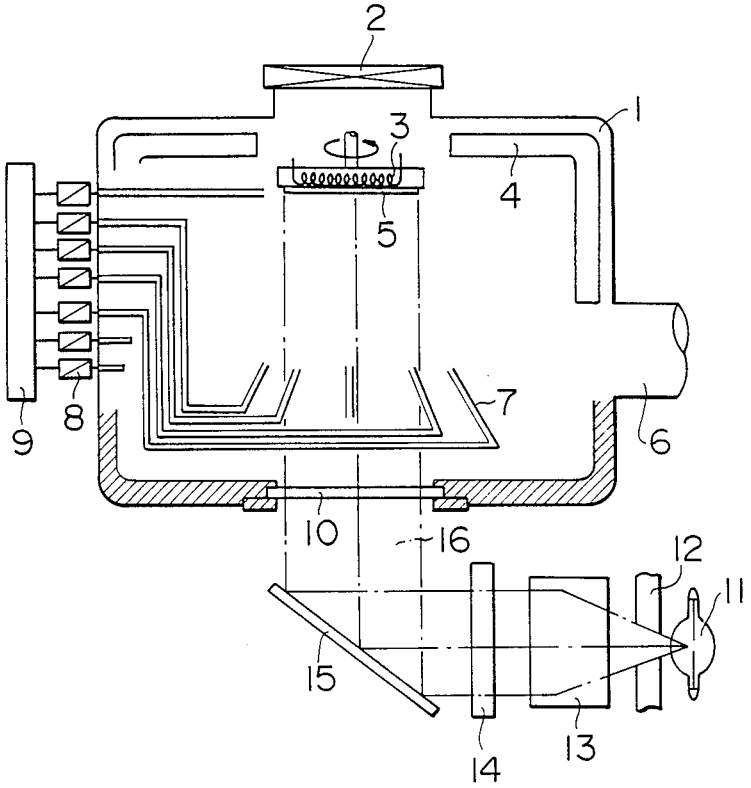
FIG. 1 is a diagramatic view of an illustrative apparatus for production of the EL elements according to this invention, FIGS. 2-*a, b, c, d* and *e* are illustrative views which show the production processes, respectively.
Figure 2A:
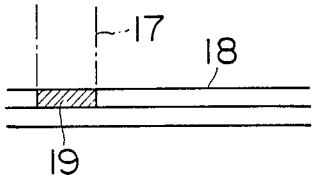
Figure 2D:
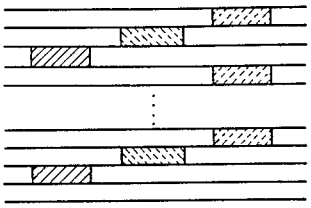
Figure 2B:
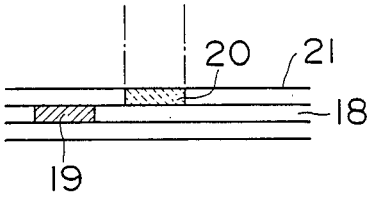
Figure 2C:
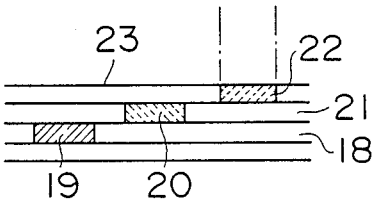
Figure 2E:
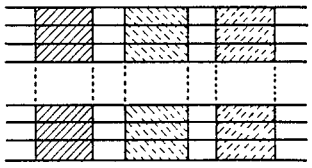

The electroluminescent display apparatus according to this invention can be produced by applying the forming method of ZnS:X, CaS:X or SrS:X films obtained by the MOCVD method to the production process of the EL display apparatus.

Referring to the MOCVD method, a compound, being thermally stable at a predetermined temperature, for example, 200° C. or less, will easily cause photochemical degradation reaction by irradiating UV or visible light to liberate elements or to react with other gases to form compounds. These liberated elements or produced compounds are employed as a source gas of luminous center elements (X-R; X: luminous center element, R: residual groups of organic compounds).

For instance, the structure of an alternating EL element having a double insulating structure has a five-layered structure as a basic structure in which a transparent electrode is formed, an insulating layer is formed thereon, an illuminant layer is further provided thereon, an insulating layer is provided again thereon and finally an Al electrode is provided thereon. In the case of an EL element for direct current, an insulating layer s omitted or present in only one layer. In any case, a three-layered structure comprising an illuminant layer interposed between a pair of electrodes is a basic structural unit. An alternating EL element is explained below.

An illuminant layer is manufactured by doping an activator into a base substance. The base substance comprises organo metals containing IIa and IIb elements and chalcogenic elements, and preferably is prepared by reacting either one of zinc alkyls such as zinc dimethyl $(CH_3)_2Zn$, zinc diethyl $(C_2H_5)_2Zn$ or zinc diacetate $(OCOCH_3)_2Zn$ with either one of hydrogen sulfide $H_2S$, sulfur dimethyl $(CH_3)_2S$, sulfur diethyl $)C_2H_5)_2S$, hydrogen selenide $H_2Se$, selenium dimethyl $(CH_3)_2Se$, selenium diethyl $(C_2H_5)_2Se$, selenium sulfide SeS, $CH_3SH$,$C_2H_5SH$,$CH_3SeH$ or $C_2H_5SeH$. The base substances ZnS or ZnSe of the illuminant layer will produce cubic-ZnS or cubic-ZnSe films having a preferred crystallizability on forming at a temperature of the substrate of 250°–400° C. On reacting with either one of dicyclopentadienyl calcium $(C_5H_5)_2Ca$, dimethylcyclopentadienyl calcium $(CH_3C_5H_4)_2Ca$, $H_2S$, $(CH_3)_2S$ or $(C_2H_5)_2S$, a CaS film having a preferred crystallizability is obtained at the temperature of the substrate of 370° C. Further, on reacting with dicyclopentadienyl strontium $(C_5H_5)_2Sr$, dimethylcyclopentadienyl strontium $(CH_3C_5H_4)_2Sr$, $H_2S$, $(CH_3)_2S$ or $(C_2H_5)_2S$, a SrS film having a preferred crystallizability is obtained at the temperature of the substrate of 340° C.

As the source gas for the luminous center, that is, the organometallic compound which will produce the metal and an activator upon decomposition, there may be employed organometallic compounds having an element such as Ce, Er, Eu, Tb, Sm or the like as the center of the compound represented by the general formula $(C_5H_5)_3Zr$ or $(CH_3C_5H_4)_3Zr$. Compounds such as $(C_5H_5)_2Mn$, $(CH_3C_5H_4)Mn(CO)_3$ or other compounds such as manganese phthalocyanine, manganese porphyrin or the like are also used effectively. Cyclopentadienyl manganese $(CH_3C_5H_4)_2Mn$, tricyclopentadienyl cerium $(C_5H_5)_3Ce$, tricyclopentadienyl erbium $(C_5H_5)_3Er$, tricyclopentadienyl europium $(C_5H_5)_3Eu$, tricyclopentadienyl terbium $(C_5H_5)_3Tb$ and tricyclopentadienyl samarium $(C_5H_5)_3Sm$ are used practically. These materials have a thermal decomposition temperature of 400°–550° C., which is higher than the optimal crystallization temperature of the base substance in a range of 30° C.–200° C. However, the above-mentioned materials have a charge transfer absorption zone from the center metal to the pentadienyl ring at the visible region, so that these materials exhibit sequentially brown, orange, pink, brown and orange. Therefore, it is also possible to liberate easily the center metal even at a low temperature of 250°–400° C. by irradiating UV or visible light at the wavelength corresponding to the above-mentioned absorption zone. The feature of this invention consists in positively utilizing the differences of the physical-chemical properties of the aforementioned compounds.

An preparation example of two-colored EL element of green and red will be explained below.

A preferred CaS crystal can be obtained by reacting the source for the base substance $(C_5H_5)_2Ca/H_2$ on the substrate (at a temperature of 300° C.). A carrier gas may be $H_2$ or other inert gases such as He, Ar or the like. When a light pattern (A) is irradiated through a suitable photomask with the use of light from a light source having a relatively high irradiation density at a wavelength around the range of 250–500 nm and simultaneously the $(C_5H_5)_3Ce/H_2$ gas is introduced into a reactor for 1 minute, a CaS:Ce green illuminant center layer having a film thickness of about 10 nm is formed (first step). Next, after the unreacted $(C_5H_5)_3Ce/H_2$ gas in the reactor is exhausted, another light pattern (B) which is different from the light pattern (A) is irradiated and simultaneously $(C_5H_5)_3Eu/H_2$ gas is introduced into the reactor for 1 minute to form in the same manner a CaS:Eu red illuminant center layer having a film thickness of 10 nm (second step). The shortest distance between the aforementioned patterns (A) and (B) within the directions of the CaS surfaces on which no illuminant center is contained is set in about 100 μm. Upon forming a two-color illuminant layer after repeating the aforementioned steps 25 times respectively to achieve the required brightness, an EL element which will exhibit a plurality of different luminescences can be produced in one illuminant layer by annealing at 500° C. for 15 minutes. It is apparent that the heat annealing is not necessarily required if the dopant concentration is selected appropriately.

The electroluminescent display apparatus according to this invention and the production process thereof makes possible the formation of a multi-color electroluminescent display apparatus having a single structure in a plane by doping at least 2 or more activators having different luminescent colors at different locations in a base substance intended to form an illuminant layer which is interposed between a pair of electrodes. The electroluminescent display apparatus has a simple construction of the operating circuit and thus can be manufactured inexpensively (at a cost of a third of that of the conventional apparatus). It is also possible to obtain a reliable multi-color electroluminescent panel which will not cause the decrease of brightness or the share in colors due to the reflection between multi-layered films or the interference effect as were caused in conventional products, so that the brightness is 2 or 3 times higher than that of conventional products and defects in the picture element are reduced to a half.

This invention is explained in Examples below with reference to the drawings. FIG. 1 is an illustrative view of an apparatus for producing the EL element according to this invention. In this drawing, there is provided within the reactor 1 a stand 3 for supporting a rotating substrate said stand being provided with a heating device; a plurality of plenums 7, having electromagnetic valves 8; and a discharge aperture 6 for various gases, and the interior surface of the upper half of the reactor 1 is covered with a shroud 4. On the other hand, a beam 16 of UV and visible light which has been irradiated from a light source 11 and transmitted to the photomask 14 through a slit 12 and a beam expander 13, is reflected on a light path controlling mirror 15, and then irradiated from a quartz window 10 of the reactor 1, which is provided oppositely to the stand 3 for supporting the rotating substrate, on the substrate 5 on the supporting stand 3.

EXAMPLE 1

On the stand for supporting the substrate having been heated to 350° C., a substrate 5 comprising a glass plate/ITO/$SiO_2$/$Ta_2O_5$ was provided, and the vacuum level of the reactor 1 was maintained constant at $10^{-5}$ Torr. The ITO electrode used was the one having a width of 160 μm and having been patterned into a shape of 3 stripes/mm. In the reactor 1 was charged $(C_5H_5)_2Ca/H_2$ (gas 1) and $H_2S$ (gas 2) in a flow rate of $10^{-5}$ mol/min and $5\times10^{-5}$ mol/min, respectively. Upon charging, the vacuum level was raised up to $10^{-4}$ Torr. ITO electrodes in a shape of 3 stripes/mm were named as A, B, A, B, etc. beginning from the left, respectively. After 2 minutes from the introduction of gas 1 and gas 2, UV and visible light (2 kW Xe lamp, wavelength region: 250–430 nm) were irradiated on the substrate 5 through a photomask 14 with a square island pattern having a width of 160 μm which was coincided with the stripe of A to form a light pattern 17 on the substrate 5. At this time, the electromagnetic valve 8 was opened and $(C_5H_5)_3Ce/H_2$ was introduced at a flow rate of $3\times10^{-7}$ mol/min for 1 minute. Upon closing the electromagnetic valve 8, a CaS:Ce film 19 having a thickness of 100 Å was formed on the CaS layer 18 having a thickness of 200 Å corresponding to the light pattern 17.

In the same manner, the photomask 14 was shifted so as to make a square island shape pattern having a width of 160 nm which coincided with the stripe of B, and a pattern with the square island shape was formed on the substrate 5. In this time, $(C_5H_5)_3Eu/H_2$ was introduced at a flow rate of $2\times10^{-7}$ mol/min for 1 minute. A CaS:Eu red illuminant layer 20 having a thickness of 10 nm was formed on the CaS layer 18 having a thickness of 30 nm corresponding to the island pattern B on the substrate 5. These operations were alternatively repeated 25 times. The EL illuminant layers comprising a ultra-structure consisting of the CaS:Ce green illuminant layer and the CaS:Eu red illuminant layer and having a thickness of 0.5 μm were formed respectively on the ITO patterns of A and B in a shape of a square island.

When heat annealing was conducted at a temperature of 450° C. for 20 minutes, Ce and Eu were diffused into the thickness of the film, and CaS:Ce and CaS:Eu having respectively an optimal illuminant concentration of 1.0 mol % and 0.2 mol % were formed on each of the patterns of square island shapes. These illuminant center elements are practically in a local concentration of 0.01–3 mol %, preferably 0.1–1 mol % regardless of conducting annealing or not. Next, a $SiO_2/Ta_2O_3$ insulating film was formed on the illuminant layer, and the Al electrodes in a shape of stripes were formed by deposition so that they coincided with the aforementioned patterns. A green-red two color EL element with a single layer was thus obtained.

EXAMPLE 2

Figure 3:
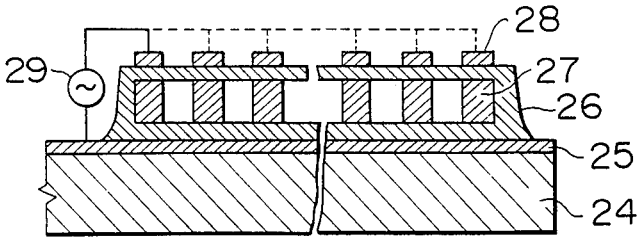
FIG. 3 is an illustrative section view of the EL display apparatus according to this invention.
Figure 4:
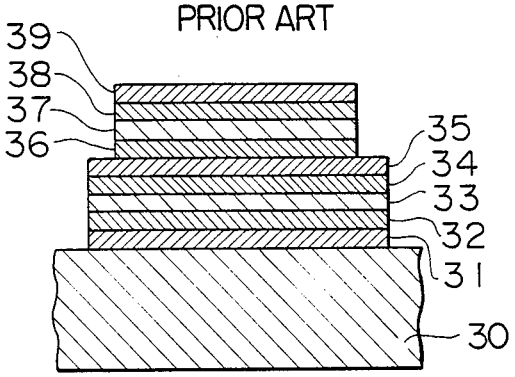
FIG. 4 PRIOR ART
FIG. 4 is a section view of the conventional EL element.

On the stand for supporting the substrate having been heated to 350° C., a substrate 5 comprising a glass plate/ITO/$SiO_2/Ta_2O_5$ was provided The ITO electrode used was the one having a width of 160 μm and having been patterned into a shape of 3 stripes/mm. ITO electrodes in a shape of 3 stripes/mm were named as A, B, C, A, B, C, etc. beginning from the left, respectively. UV and visible light (2 kW Xe lamp, wavelength region: 300–500 nm) were irradiated on the substrate 5 through a photomask 14 with a square island pattern having a width of 160 μm which was coincided with the stripe of A to form a light pattern 17 on the substrate 5 (FIG. 2-*a*). Next, the electromagnetic valve 8 was opened and $(C_5H_5)_2Sr/H_2$ (gas 1) and $H_2S$ (gas 2) were introduced at a flow rate of $10^{-5}$ mol/min and $7\times10^{-7}$ mol/min, respectively for 1 minute. A SrS:Eu red illuminant layer 19 having a thickness of 10 nm was formed corresponding to the light pattern 17. Next, the photomask 14 was shifted so as to make a square island shape pattern having a width of 160 μm which coincided with the stripe of B. Next, $(C_5H_5)_3Ce/H_2$ was introduced into the reactor 1 at a flow rate of $1\times10^{-7}$ mol/min for 1 minute. A SrS:Ce blue illuminant layer 20 having a thickness of 10 nm was formed on the SrS layer 18 having a thickness of 10 nm corresponding to the island pattern B on the substrate 5 (FIG. 2-*b*). Next, the electromagnetic valve 8 was closed to stop the introduction of gas 1 and the photomask 14 was shifted so as to be a square island pattern which coincided with the stripe of C and had a width of 160 μm. The electromagnetic valve 8 was opened, and $(C_5H_5)_2Ca/H_2$ was introduced into the reactor 1 at a flow rate of $10^{-5}$ mol/min for 1 minute. $(C_5H_5)_3Ce/H_2$ was simultaneously introduced into the reactor 1 at a flow rate $1\times10^{-7}$ mol/min for 1 minute. A CaS:Ce green illuminant layer 22 having a thickness of 10 nm was formed on the SrS layer 18 having a thickness of 20 nm corresponding to the island pattern C (FIG. 2-*b*). Taking these operations as a unit cycle, operations were repeated 17 cycles. The EL illuminant layer comprising an ultra-structure consisting of the SrS:Eu red illuminant layer and having a thickness of 0.5 μm was formed respectively on the ITO patterns of A, B and C in a shape of a square island (FIG. 2-*d*). Next, as shown in FIG. 3, a $SiO_2/Ta_2O_3$ insulating layer 26 was formed on the illuminant layer 27 (the illuminant layer being provided on electrode 25 (ITO transparent electrode), which electrode is provided on glass substrate 24), and the Al electrodes 28 in a shape of stripes were formed in a rectangular direction by deposition so that they coincided with the aforementioned patterns. A red-green-blue three color EL element with a single layer was thus obtained.

EXAMPLE 3

Figure 5:
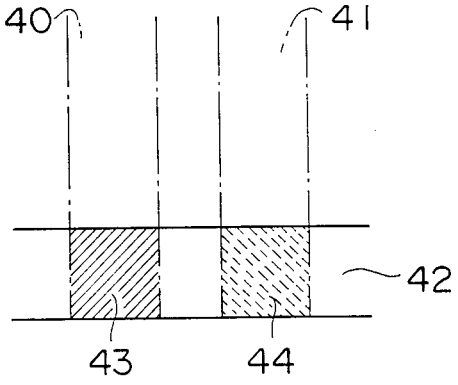
FIG. 5 is a view of the EL display apparatus according to this invention and illustrating an Example of the production process thereof.

On the stand for supporting the substrate having been heated to 350° C., a substrate 5 comprising a glass plate/ITO/$SiO_2/Ta_2O_5$ was provided, and the vacuum level of the reactor 1 was maintained constant at $10^{-6}$ Torr. The ITO electrode used was the one having a width of 160 μm and having been patterned into a shape of 3 stripes/mm. ITO electrodes in a shape of 3 stripes/mm were named as A, B, A, B, etc. beginning from the left, respectively. UV light 40 having a wavelength of 310–340 nm and visible light 41 having a wavelength of 410–440 nm were irradiated on the substrate 5 through a photomask 14 with a square island pattern having a width of 160 μm which coincided with the stripe of A and through a photomask 14 with a square island pattern having a width of 160 μm which coincided with the stripe of B, respectively, to form a light pattern 17 on the substrate 5. Next, the electromagnetic valve 8 was opened and $(C_5H_5)_2Ca/H_2$ as the source gas for the base substance and $H_2S$ were introduced into the reactor 1 at a flow rate of $10^{-5}$ mol/min and $5\times10^{-5}$ mol/min, respectively, for 1 minute. Next, $(C_5H_5)_3Ce/H_2$ and $(C_5H_5)_3Eu/H_2$ were respectively introduced into the reactor through different plenums 7 at a flow rate of about $10^{-7}$ mol/min. A CaS:Ce green illuminant layer 43 and CaS:Eu red illuminant layer 44 were formed respectively in the CaS base substance crystal 42 corresponding to the light patterns A and B (FIG. 5). Next, as shown in FIG. 3, a $SiO_2/Ta_2O_5$ insulating layer 26 was formed on the illuminant layer 27, and the Al electrodes 28 in a shape of stripes were formed in a rectangular direction to the direction of the ITO electrodes 25 by deposition so that they coincided with the aforementioned patterns. A green-red two color EL element with a single layer was thus obtained.

In the aforementioned Examples, a pair of electrode layers are formed. Both or either one of these electrodes may be transparent, or neither of these electrodes may be transparent. If both of them are nontransparent, light is taken out from a part or the whole of the side surface of the illuminant layer. In the electroluminescent display apparatus according to this invention, an optional illuminant element may be doped at optional portions of the illuminant layer, so that it is also possible to produce the electroluminescent display apparatus as described above.

What is claimed is:

1. An electroluminescent display apparatus comprising:

a pair of electrode layers of which at least one is divided into a plurality of electrodes; and an illuminant layer interposed between said pair of electrode layers, said illuminant layer including a base substance and a plurality of activators each selectively doped into the base substance so as to provide a plurality of respective luminant regions in the illuminant layer, each one of the luminant regions illuminating with a desired color in accordance with the respective type of activator doped into the base substance in the respective luminant region.

2. An electroluminescent display apparatus as claimed in claim 1, wherein the base substance of said illuminant layer is a substance formed by reacting a source material of organo-metallic compounds containing IIa elements.

3. An electroluminescent display apparatus as claimed in claim 1, wherein the base substance of said illuminant layer is a substance formed by reacting a source material of organo-metallic compounds containing IIb elements.

4. An electroluminescent display apparatus as claimed in claim 1, wherein the base substance of said illuminant layer is a substance formed by reacting a source material of organo-metallic compounds containing VI elements.

5. An electroluminescent display apparatus as claimed in claim 1, wherein the activator doped into the base substance is a metal produced by the decomposition of at least a compound selected from the group consisting of $(C_5H_5)_3X$, $(CH_3C_5H_4)_3X$, $(C_5H_5)_2Mn$ and $(CH_3C_5H_4)Mn(CO)_3$, in which X represents Ce, Tb, Sm, Er or Eu.

6. An electroluminescent display apparatus as claimed in claim 1, wherein at least one insulating layer is interposed between said illuminant layer and said pair of electrode layers.

7. An electroluminescent display apparatus as claimed in claim 2, wherein the source material of organo-metallic compounds containing IIa elements is selected from the group consisting of $(C_5H_5)_2Ca$, $(C_5H_5)_2Sr$, $(CH_3C_5H_4)_2Ca$ and $(CH_3C_5H_4)_2Sr$.

8. An electroluminescent display apparatus as claimed in claim 3, wherein the source material of organo-metallic compounds containing IIb elements is selected from the group consisting of $(CH_3)_2Zn$, $(C_2H_5)_2Zn$ and $(OCOCH_3)_2Zn$.

9. An electroluminescent display apparatus as claimed in claim 4, wherein the source material of organo-metallic compounds containing VI elements is selected from the group consisting of $H_2S$, $(CH_3)_2S$, $(C_2H_5)_2S$, $CH_3SH$, $C_2U_5SH$, $H_2Se$, $(CH_3)_2Se$, $(C_2H_5)_2Se$, $CH_3SeH$ and $C_2H_5SeH$.

10. An electroluminescent display apparatus as claimed in claim 1, wherein the base substance is a substance formed by metal-organic chemical vapor deposition of an organo-metallic compound containing IIa, IIb or VI elements.

11. An electroluminescent display apparatus as claimed in claim 1, wherein said plurality of luminant regions are in different spatial locations in the illuminant layer.

12. An electroluminescent display apparatus as claimed in claim 1, wherein said plurality of luminant regions are in different spatial locations in the same plane.

13. An electroluminescent display apparatus as claimed in claim 1, wherein the base substance, into which the plurality of activators are doped to form the plurality of luminant regions, is made of a material selected from the group consisting of ZnS, ZnSe, CaS and SrS.

14. An electroluminescent display apparatus as claimed in claim 13, wherein the base substance is a crystal film of said material.

15. An electroluminescent display apparatus as claimed in claim 1, wherein the base substance is a crystal film.

16. An electroluminescent display apparatus as claimed in claim 1, wherein different ones of said plurality of activators are doped into different locations of the base substance so as to provide said plurality of luminant regions in said illuminant layer.

17. An electroluminescent display apparatus as claimed in claim 5, wherein the activators doped into the base substance are elements selected from the group consisting of Ce, Er, Eu, Tb and Sm, formed by decomposing a compound containing the element, by irradiating UV or visible light.

18. An electroluminescent display apparatus as claimed in claim 1, wherein the plurality of activators are contained in the luminant regions in concentrations of 0.01 to 3 mol %.

19. An electroluminescent display apparatus as claimed in claim 6, wherein said at least one insulating layer is a $SiO_2/Ta_2O_3$ film located between the illuminant layer and a respective one of the pair of electrode layers.

20. An electroluminescent display apparatus as claimed in claim 19, wherein said one of the pair of electrode layers, adjacent the $SiO_2/Ta_2O_3$ film, is made of Al.

21. An electroluminescent display apparatus comprising:

a pair of electrodelayers of which one layer is divided into a plurality of electrodes, and the other is formed as a series of electrodes in the shape of stripes, the stripes extending in a direction perpendicular to that of the plurality of electrodes, an illuminant layer interposed between the pair of electrode layers, the illuminant layer having a base substance and a plurality of activators each selectively doped in the base substance, the plurality of activators being doped in the base substance so as to provide a plurality of luminant regions respectively made of the base substance and the activators doped in the base substance in the respective luminant region, with each one of the luminant regions illuminating with a desired color in accordance with the type of the activators doped therein, and an insulating layer provided between the illuminant layer and at least one of the pair of electrode layers.

22. An electroluminescent display apparatus as claimed in claim 21, wherein the plurality of luminant regions are located so as to coincide with the series of electrodes in the form of stripes of the other layer of the pair of electrode layers.

23. An electroluminescent display apparatus as claimed in claim 1, wherein each of the plurality of activators is respectively selectively doped into the base substance so as to provide the plurality of respective luminant regions.

24. An electroluminescent display apparatus as claimed in claim 11, wherein the plurality of luminant regions are in the different spatial locations due to the plurality of activators respectively being selectively doped in the base substance in different locations.

25. An electroluminescent display apparatus as claimed in claim 12, wherein said plurality of luminant regions are spaced from each other in the same plane.

26. An electroluminescent display apparatus as claimed in claim 1, wherein said plurality of luminant regions are spaced from each other.

27. An electroluminescent display apparatus as claimed in claim 21, wherein each of the plurality of activators is respectively selectively doped into the base substance so as to provide the plurality of respective luminant regions.

28. An electroluminescent display apparatus as claimed in claim 21, wherein said plurality of luminant regions are in different spatial locations in the illuminant layer.

29. An electroluminescent display apparatus as claimed in claim 21, wherein said plurality of luminant regions are in different spatial locations in the same plane.

30. An electroluminescent display apparatus as claimed in claim 29, wherein said plurality of luminant regions are spaced from each other in the same plane.

* * * * *